US010716721B2

(12) United States Patent
Culver et al.

(10) Patent No.: US 10,716,721 B2
(45) Date of Patent: Jul. 21, 2020

(54) HINGE ASSEMBLY FOR A WHEELCHAIR COMPONENT

(71) Applicant: The Comfort Companies, Inc., Bozeman, MT (US)

(72) Inventors: Craig Culver, Neosho, WI (US); Steven DuFresne, Hartland, WI (US)

(73) Assignee: THE COMFORT COMPANIES, LLC, Bozeman, MT (US)

( * ) Notice: Subject to any disclaimer, the term of this patent is extended or adjusted under 35 U.S.C. 154(b) by 90 days.

(21) Appl. No.: 16/101,054

(22) Filed: Aug. 10, 2018

(65) Prior Publication Data

US 2019/0046375 A1 Feb. 14, 2019

Related U.S. Application Data

(60) Provisional application No. 62/544,158, filed on Aug. 11, 2017.

(51) Int. Cl.
*A61G 5/12* (2006.01)
*E05D 3/10* (2006.01)
(Continued)

(52) U.S. Cl.
CPC ..... *A61G 5/121* (2016.11); *E05D 3/10* (2013.01); *E05D 5/128* (2013.01); *A47C 7/38* (2013.01);
(Continued)

(58) Field of Classification Search
CPC .... A61G 5/121; A61G 7/1084; A61G 15/125; A61G 2200/34; E05D 3/10; E05D 5/128;
(Continued)

(56) References Cited

U.S. PATENT DOCUMENTS 2,560,925 A 7/1951 Brown
2,613,725 A 10/1952 Woodhall
(Continued)

FOREIGN PATENT DOCUMENTS

CN 203122811 U * 8/2013
CN 106137594 A * 11/2016
(Continued)

OTHER PUBLICATIONS

International Search Report and Written Opinion for Application No. PCT/US2018/046271 dated Oct. 24, 2018, 13 pages.

*Primary Examiner* — William L Miller
(74) *Attorney, Agent, or Firm* — Michael Best & Friedrich LLP

(57) ABSTRACT

A hinge assembly includes a first hinge member including a first outer finger defining a first aperture, the first aperture including a first circumferential tapered surface, a second hinge member including a second outer finger defining a second aperture, the second aperture including a second circumferential tapered surface, and a fastener assembly including a first hub, a second hub, and a fastener, the first hub including a circumferential tapered surface that is complimentary to the first circumferential tapered surface, and the second hub including a circumferential tapered surface that is complimentary to the second circumferential tapered surface, the fastener assembly is configured to connect the first hinge member to the second hinge member.

31 Claims, 10 Drawing Sheets

(51) Int. Cl.

| | |
|---|---|
| ***E05D 5/12*** | (2006.01) |
| *A61G 7/10* | (2006.01) |
| *A61G 15/12* | (2006.01) |
| *A47C 7/38* | (2006.01) |

(52) U.S. Cl.
CPC ..... *A61G 7/1084* (2013.01); *A61G 15/125* (2013.01); *A61G 2200/34* (2013.01)

(58) Field of Classification Search
CPC ..... A47C 7/38; Y10T 16/5474; Y10T 16/547; Y10T 16/5472; Y10T 16/557; F16C 11/04
USPC ..... 16/366, 367, 368, 386; 297/391, 408, 297/410, DIG. 4; 280/250.1; 403/145
See application file for complete search history.

(56) References Cited

U.S. PATENT DOCUMENTS

| | | | |
|---|---|---|---|
| 2,652,221 | A | 9/1953 | Kampa |
| 2,740,467 | A | 4/1956 | Page |
| 3,497,259 | A | 2/1970 | Sherfey |
| 3,561,792 | A | 2/1971 | Cycowicz |
| 3,643,996 | A | 2/1972 | Carnahan |
| 3,730,589 | A | 5/1973 | Lane |
| 3,877,751 | A | 4/1975 | Rasmussen |
| 3,885,831 | A | 5/1975 | Rasmussen |
| 3,964,788 | A | 6/1976 | Kmetyko |
| 4,466,662 | A | 8/1984 | McDonald et al. |
| 4,641,883 | A | 2/1987 | Kato |
| 4,796,953 | A | 1/1989 | Pereira |
| 5,308,028 | A | 5/1994 | Komberg |
| 5,332,287 | A | 7/1994 | Whitmyer |
| 5,378,043 | A | 1/1995 | Viano et al. |
| 5,463,795 | A | 11/1995 | Carlson et al. |
| 5,791,735 | A | 8/1998 | McKeever |
| 5,967,613 | A | 10/1999 | McKeever |
| 6,199,947 | B1 | 3/2001 | Wiklund |
| 6,419,321 | B1 | 7/2002 | Sack |
| 6,761,338 | B2 | 4/2004 | Yamasaki |
| 6,755,472 | B2 | 6/2004 | Stenzel et al. |
| 6,860,564 | B2 | 3/2005 | Reed et al. |
| 6,962,392 | B2 | 11/2005 | O'Conner |
| 6,976,699 | B2 | 12/2005 | Koerlin |
| 7,640,090 | B2 | 12/2009 | Uchida et al. |
| 7,832,803 | B2 | 11/2010 | Cassaday |
| 8,088,058 | B2 | 1/2012 | Juliana et al. |
| 8,696,065 | B2 | 4/2014 | Udriste et al. |
| 8,911,019 | B2 | 12/2014 | Josten et al. |
| 8,979,196 | B2 | 3/2015 | Simpson |
| 9,061,616 | B2 | 6/2015 | Kondrad et al. |
| 2003/0014839 | A1 | 1/2003 | Wu |
| 2003/0178880 | A1 | 9/2003 | Hannah |
| 2004/0086325 | A1 | 5/2004 | Friesen et al. |
| 2006/0157627 | A1 | 7/2006 | Hung |
| 2007/0085401 | A1 | 4/2007 | Hunziker et al. |
| 2009/0151124 | A1 | 6/2009 | Forrest |
| 2012/0261965 | A1 | 10/2012 | Elizalde |
| 2012/0292973 | A1 | 11/2012 | Westerink et al. |
| 2013/0069411 | A1 | 3/2013 | Walker et al. |
| 2013/0257014 | A1 | 10/2013 | Stephens |
| 2015/0068345 | A1 | 3/2015 | Josten et al. |
| 2017/0224117 | A1* | 8/2017 | DuFresne ..... A61G 5/121 |

FOREIGN PATENT DOCUMENTS

| | | | | |
|---|---|---|---|---|
| CN | 206214311 | U | * | 6/2017 |
| CN | 206252596 | U | * | 6/2017 |
| CN | 108433898 | A | * | 8/2018 |
| CN | 208372048 | U | * | 1/2019 |
| CN | 208435956 | U | * | 1/2019 |
| EP | 2389915 | A1 | | 11/2011 |
| JP | 2005245872 | A | * | 9/2005 |
| WO | 2013133788 | A1 | | 9/2013 |

* cited by examiner

HINGE ASSEMBLY FOR A WHEELCHAIR COMPONENT

CROSS REFERENCE TO RELATED APPLICATIONS

This application claims priority to U.S. Provisional Patent Application No. 62/544,158, entitled ARTICULATING HEAD SUPPORT and filed on Aug. 11, 2017, the entire contents of which is herein incorporated by reference in its entirety.

FIELD

The present disclosure relates to a hinge assembly for an articulating wheelchair component. More specifically, the present disclosure relates to an improved hinge assembly that provides a wide range of motion, improved strength, and can be used to support a component of a wheelchair, such as a head support.

SUMMARY

In one embodiment, the disclosure provides a hinge assembly that includes a first hinge member including a first outer finger defining a first aperture, the first aperture including a first circumferential tapered surface, a second hinge member including a second outer finger defining a second aperture, the second aperture including a second circumferential tapered surface, and a fastener assembly including a first hub, a second hub, and a fastener, the first hub includes a circumferential tapered surface that is complimentary to the first circumferential tapered surface, and the second hub includes a circumferential tapered surface that is complimentary to the second circumferential tapered surface. The fastener assembly is configured to connect the first hinge member to the second hinge member by the first hub being received by the first aperture such that the circumferential tapered surface of the first hub engages the first circumferential tapered surface of the first aperture, the second hub being received by the second aperture such that the circumferential tapered surface of the second hub engages the second circumferential tapered surface of the second aperture, and the fastener coupling the first hub to the second hub.

In another embodiment, the disclosure provides a hinge assembly that includes a first hinge member including a first outer finger defining a first aperture, a second hinge member including a second outer finger defining a second aperture, and a fastener assembly including a first hub, a second hub, and a fastener, the first hub defines an opening and the second hub includes a projection. The fastener assembly is configured to be received by the first and second apertures, and the opening defined by the first hub is configured to receive the projection of the second hub to selectively connect the first hinge member to the second hinge member.

In another embodiment, the disclosure provides an articulating head support including an articulating arm. The articulating arm includes at least a first member and a second member. The first and second members each include a first end and a second end opposite the first end. Each end includes a plurality of spaced apart fingers, and each finger defines an aperture. The first member couples to the second member by a meshing relationship of the fingers, where the apertures align to receive a fastener. The aligned apertures also define an axis. The first and second members rotate relative to each other about the axis.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

While the present disclosure illustrates an articulating head support 10 that is configured for use with a chair, and more specifically a wheelchair, it should be appreciated that the articulating head support 10 is not limited for use with a wheelchair. The articulating head support 10 can be used with any suitable chair or support device suitable to support a person while sitting. Accordingly, as used herein, the term "chair" can include, but is not limited to, a wheelchair, an armchair, a rocking chair, a car seat, a swivel chair, an office chair, a recliner, a director's chair, a high chair, a sofa, a backed stool, and/or any clinical/medical chair such as a surgical chair, dental chair, chiropractic chair or massage chair. Accordingly, the articulating head support 10 can be connected to (or mounted on) any such suitable chair, and then adjusted to provide head support for a person that is sitting in the chair.

In addition, the present disclosure illustrates a hinge assembly 200 for use with an articulating arm 14 of a head support 10. It should be appreciated that the hinge assembly 200 is not limited for use with a head support 10, and can be used to connect any two suitable members. For example, the hinge assembly 200 can be used for other components of a wheelchair, including, but not limited to amputee supports, lateral trunk supports, lateral pelvic or thigh supports, leg supports, foot supports, or any other suitable structure attachable to a wheelchair. Further, the hinge assembly 200 can be used with any other structure where it is advantageous to have an adjustable hinge.

Referring now to the figures, FIGS. 1-10 illustrate an embodiment of the articulating head support 10 and associated hinge assembly 200. The articulating head support 10 is configured to be mounted to a suitable chair, such as a wheelchair (not shown). The articulating head support 10 is also configured to be adjusted in three dimensions, about an X-axis, a Y-axis, and a Z-axis (shown in FIG. 1), to provide head support for a person sitting in the chair.

Figure 1:
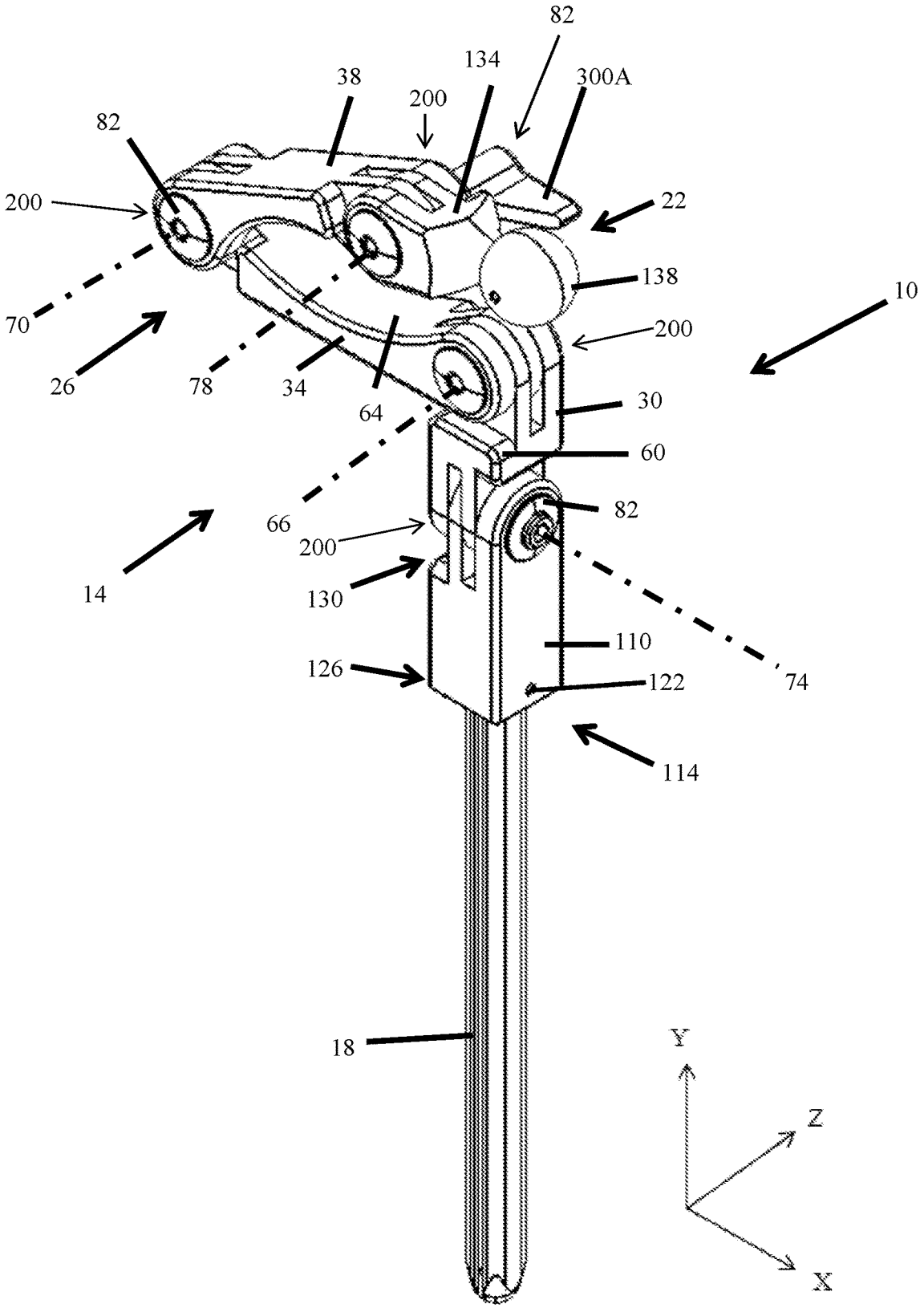
FIG. 1 is a perspective view of an embodiment of an articulating head support for use with a chair.

With reference now to FIG. 1, the articulating head support 10 includes an articulating arm 14. The articulating arm 14 is coupled to a height adjustment member 18 at a first end, and to a ball joint assembly 22 at a second end, opposite the first end. The articulating arm 14 includes an articulating portion 26 that is disposed between the height adjustment member 18 and the ball joint assembly 22. Although not illustrated, the articulating head support 10 can be moveably coupled to a chair attachment assembly. For example, the height adjustment member 18 can be slidably (or movably) coupled to a chair by a mounting bracket (or other attachment assembly) (not shown) to facilitate adjustment of the height adjustment member 18 along the Y-axis. In addition, a head support (or head rest) can be movably (or pivotally) coupled to the articulating head support 10. For example, the ball joint assembly 22 can engage the head support (not shown) such that the head support can move (or pivot) relative to the ball joint assembly 22 to facilitate adjustment and/or repositioning of the head support.

The articulating portion 26 includes a plurality of interconnected articulating members 30, 34, 38. In the illustrated embodiment, three articulating members 30, 34, 38 define the articulating portion 26 of the articulating arm 14. However, in other embodiments, one, two, or four or more members can define the articulating portion 26 of the arm 14.

Figure 2:
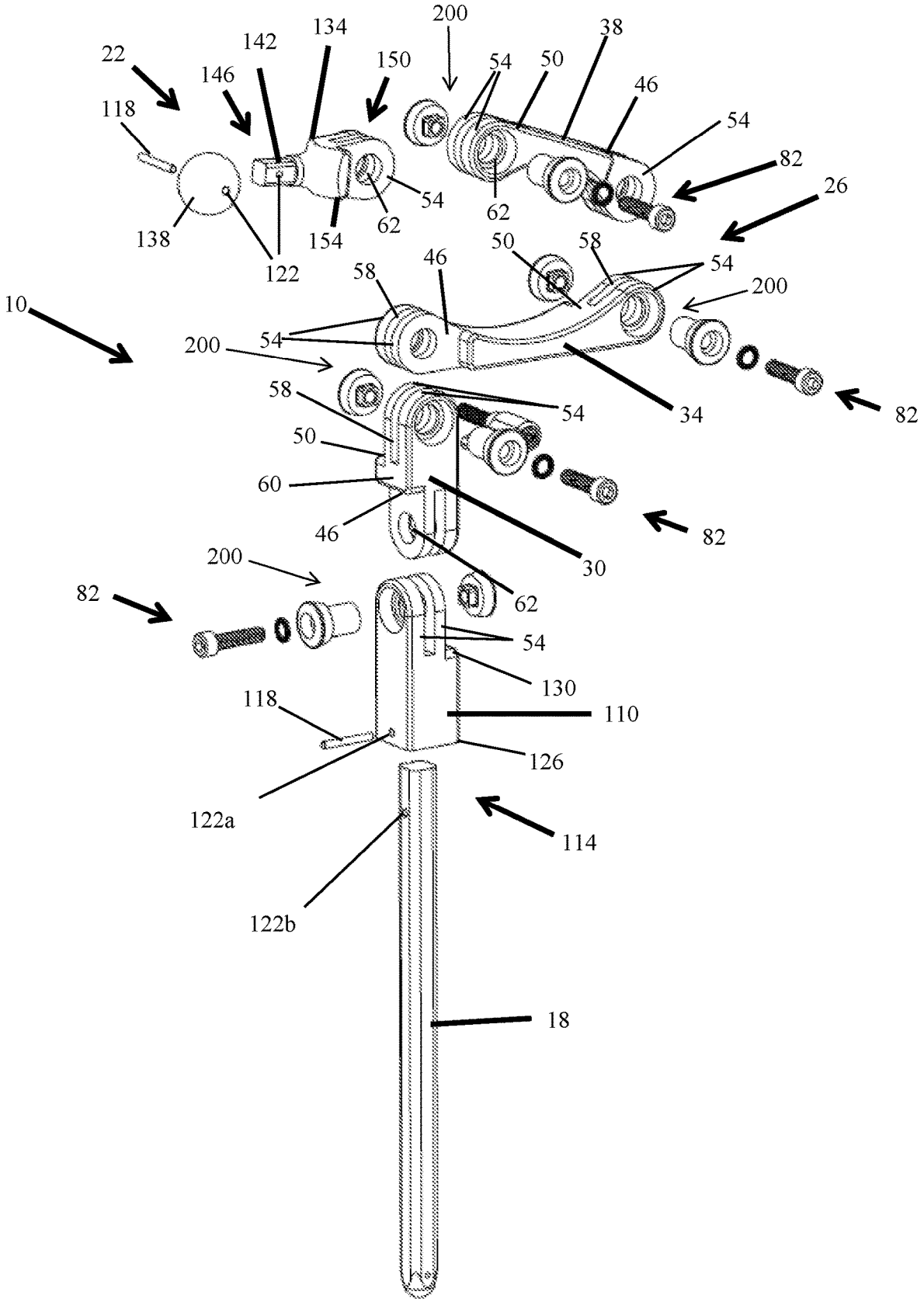
FIG. 2 is an exploded view of the articulating head support of FIG. 1.

With reference to FIG. 2, each of the articulating members 30, 34, 38 include a first end 46, and a second end 50 opposite the first end 46. Each end 46, 50 includes at least one finger 54. Each finger 54 extends (or projects) from the respective first and second ends 46, 50. In the illustrated embodiment, each end 46, 50 of the articulating members 30, 34, 38 includes a plurality of fingers 54, and more specifically two fingers 54. In other embodiments, each end can include a single finger 54 or three of more fingers 54. In embodiments incorporating a plurality of fingers 54, a space 58 is positioned between each adjacent finger 54.

With continued reference to FIG. 2, a first articulating member 30 couples the articulating portion 26 to the height adjustment member 18. The first articulating member 30 includes a first end 46, a second end 50 opposite the first end 46, and a middle section 60.

Fingers 54 extend from the first end 46, and are spaced apart by the space 58. The fingers 54 each include an aperture 62, with the apertures being aligned. The fingers 54 extending from the second end 50 each also include an aperture 62, with the apertures 62 being aligned. The fingers 54 on the first end 46 and the second end 50 are offset (e.g., rotationally offset by ninety degrees, etc.). In other words, the apertures 62 in the fingers 54 positioned on the first end 46 are aligned along a first aperture axis that is perpendicular (or orthogonal) to a second aperture axis that the apertures 62 in the fingers 54 on the second end 50 are aligned along. In other embodiments, the first aperture axis can be oriented at any suitable angle to the second aperture axis.

The first articulating member 30 is coupled to a second articulating member 34 by a fastener assembly 82. The second articulating member 34 includes a first end 46, a second end 50 opposite the first end 46, and a middle section 64. The middle section 64 has an arcuate (or curved) shape. However, in other embodiments the middle section 64 can be straight, or have any suitable shape. The fastener assembly 82 is received by aligned apertures 62 of the fingers 54 on the first and second articulating members 30, 34 to define a hinge assembly 200. More specifically, the fingers 54 on the second end 50 of the first articulating member 30 are interlayed (or intermeshed) with the fingers 54 on the first end 46 of the second articulating member 34. In other words, one of the fingers 54 on the first and second articulating members 30, 34 is received by the space 58 on the other of the second and first articulating member 34, 30, respectively. This results in the apertures 62 of the fingers 54 of the first articulating member 30 being positioned into alignment with the apertures 62 of the fingers 54 of the second articulating member 34. The aligned apertures 62 are configured to receive the fastener assembly 82, coupling the first and second articulating members 30, 34. The aligned apertures 62, and/or the fastener assembly 82, also define a first axis 66 (shown in FIGS. 1 and 10). The first articulating member 30 is configured to move (or rotate) relative to the second articulating member 34 about the first axis 66. Similarly, the second articulating member 34 is configured to move (or rotate) relative to the first articulating member 30 about the first axis 66.

The second articulating member 34 is similarly coupled to a third articulating member 38 by a fastener assembly 82. The third articulating member 38 includes a first end 46, a second end 50 opposite the first end 46, and a middle section 64. The middle section 64 has an arcuate (or curved) shape. However, in other embodiments the middle section 64 can be straight, or have any suitable shape. The fastener assembly 82 is received by aligned apertures 62 of the fingers 54 on the second and third articulating members 34, 38 to define another hinge assembly 200. The apertures 62 are aligned by interlaying (or intermeshing) the fingers 54 at the second end 50 of the second articulating member 34 with the fingers 54 at the first end 50 of the third articulating member 38. In other words, one of the fingers 54 on the second and third articulating members 34, 38 is received by the space 58 on the other of the third and second articulating member 38, 34, respectively. This results in the apertures 62 of the fingers 54 of the second articulating member 34 being positioned into alignment with the apertures 62 of the fingers 54 of the third articulating member 38. The aligned apertures 62 are configured to receive the fastener assembly 82, coupling the second and third articulating members 34, 38. The aligned apertures 62, and/or the fastener assembly 82, also define a second axis 70 (shown in FIG. 6). The second articulating member 34 is configured to move (or rotate) relative to the third articulating member 38 about the second axis 70. Similarly, the third articulating member 38 is configured to move (or rotate) relative to the second articulating member 34 about the second axis 70. In addition, the second axis 70 is generally parallel to the first axis 66.

Figure 3:
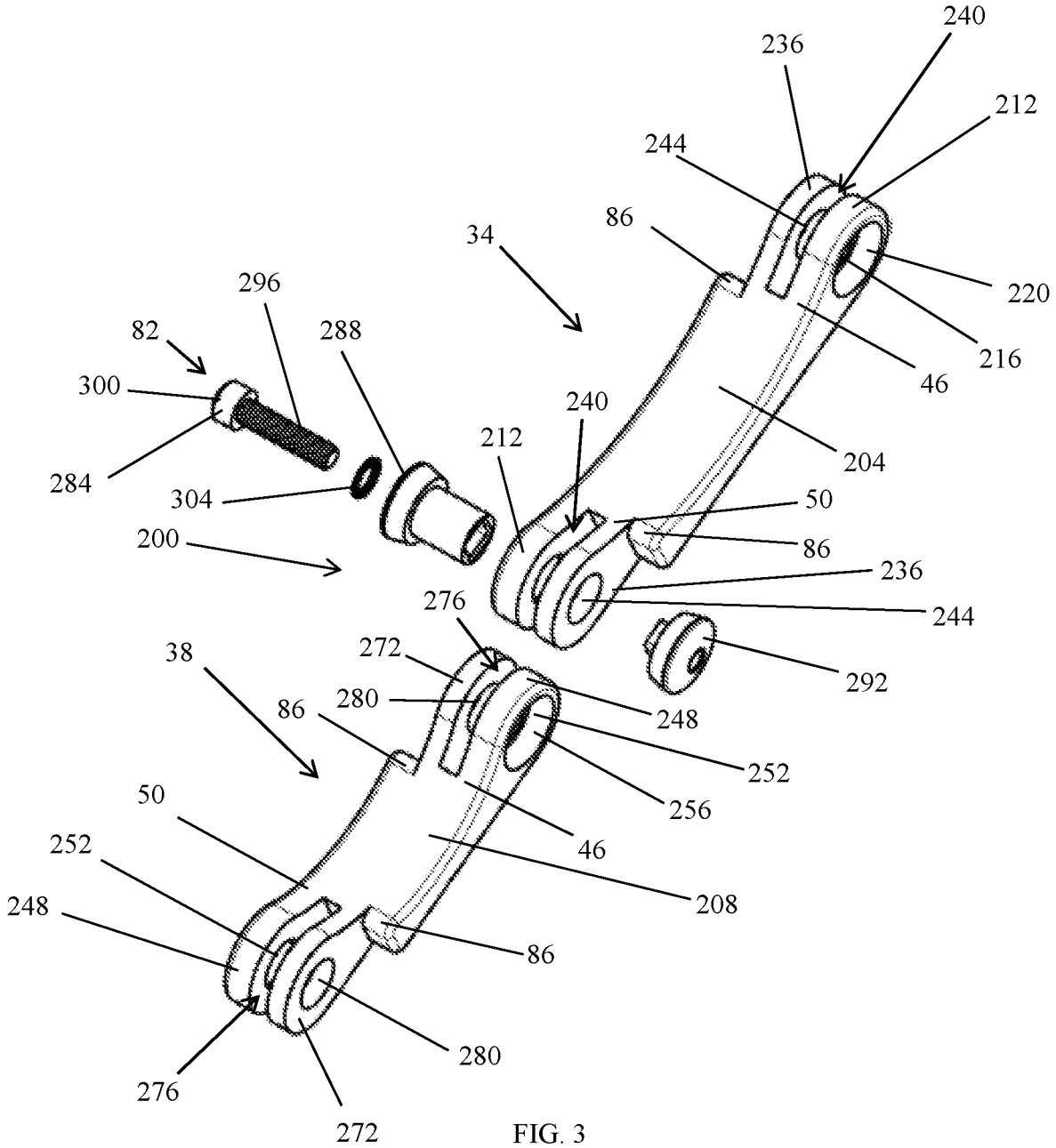
FIG. 3 is an exploded perspective view of two articulating members for use in the articulating head support of FIG. 1 provided to illustrate a hinge assembly.

FIG. 3 illustrates the hinge assembly 200 in greater detail. The hinge assembly 200 includes a first hinge member 204 coupled to a second hinge member 208 by the fastener assembly 82. In the illustrated embodiment, the first hinge member 204 is illustrated as the second articulating member 34, while the second hinge member 208 is illustrated as the third articulating member 38. In other embodiments, any two consecutive members that are configured to be coupled can be hinge members 204, 208 connected by the fastener assembly 82 to define the hinge assembly 200. For example, the hinge members 204, 208 can include the first and second articulating members 30, 34, a support stem 110 and the first articulating member 30, the third articulating member 38 and a ball joint support 134, etc.

Figure 4:
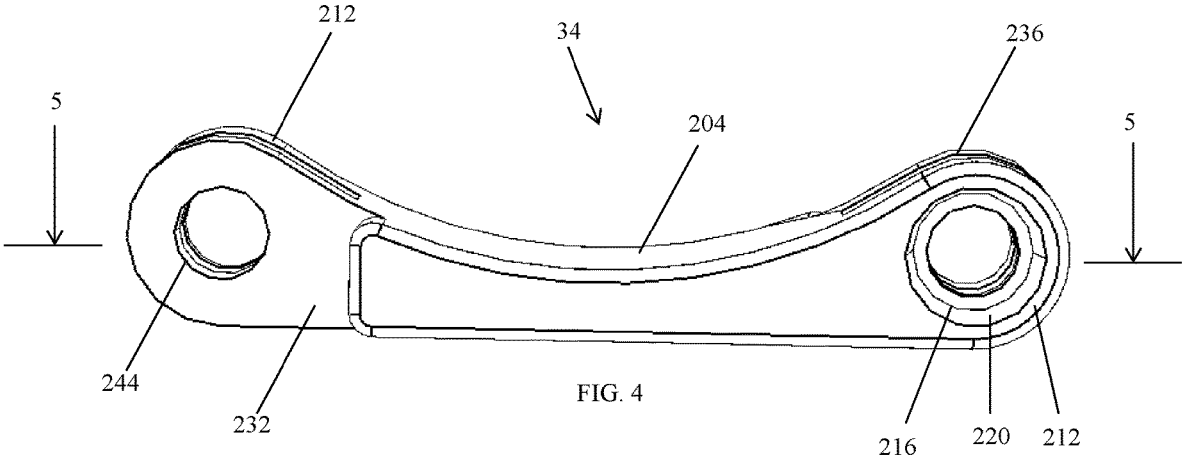
FIG. 4 is a side view of an embodiment of a first hinge member for use with the articulating head support of FIG. 1, illustrating components of a hinge assembly.
Figure 5:
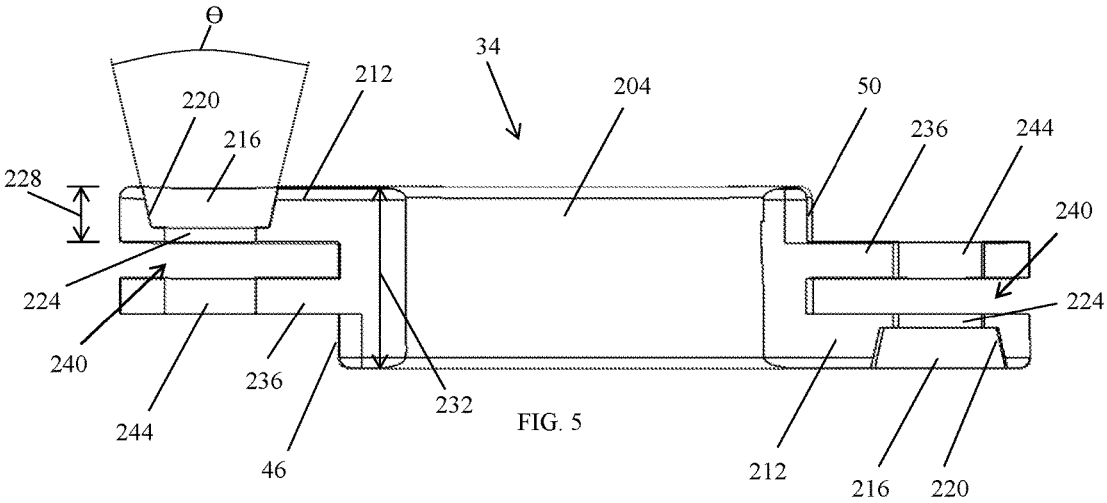
FIG. 5 is a cross-sectional view of the first hinge member of FIG. 4, take along line 5-5 of FIG. 4.

Referring to FIGS. 3-5, the first hinge member 204 includes a first outer finger 212 that is positioned on an end 46, 50 of the member 204. The first outer finger 212 defines an aperture 216 (or first aperture 216 or first outer aperture 216) that is configured to receive a portion of the fastener assembly 82. A circumference of the first aperture 216 includes a tapered surface 220 (or sloped surface 220). The tapered surface 220 defines a frustoconical cross-sectional shape. More specifically, and as shown in FIG. 5, with a cross-section of the first aperture 216 taken along a diameter, the opposing tapered surfaces 220 define an angle θ. The angle θ can be from approximately twenty degrees (20°) to approximately forty degrees (40°). The first aperture 216 includes an exit portion 224 that includes a diameter that is smaller than a diameter taken along the tapered surfaces 220. In other embodiments, the exit portion 224 can have a diameter that is equal to (or is no greater than, or is smaller than) the smallest diameter (or shortest diameter) taken across opposing tapered surfaces 220. While the tapered surface 220 of the first aperture 216 defines a frustoconical cross-sectional shape, in other embodiments the first aperture 216 can define a geometric, eccentric, or other shape having the tapered surface 220 around the circumference.

With continued reference to FIG. 5, the first outer finger 212 includes a width 228 (or thickness 228) that is less than a width 232 (or thickness 232) of the corresponding end 46, 50 of the first hinge member 204. The first hinge member 204 can also include at least one inner finger 236 that is positioned on the end 46, 50 of the member 204. In the illustrated embodiment, the first hinge member 204 includes a single inner finger 236. However, in other embodiments, the first hinge member 204 can include a plurality of inner fingers 236, or the first hinge member 204 does not include any inner fingers 236 (i.e., includes only an outer finger 212). Each inner finger 236 is spaced apart (or is offset) from the next consecutive finger. As shown in FIGS. 3 and 5, the inner finger 236 is spaced from the first outer finger 212 by a space 240. The inner finger 236 defines an aperture 244 (or inner aperture 244). The inner aperture 244 has a diameter that is approximately equal to the exit portion 224 of the first aperture 216. Stated another way, the diameter of the inner aperture 244 can have a diameter that is equal to (or is no greater than, or is smaller than) the smallest diameter (or shortest diameter) taken across opposing tapered surfaces 220 of the first aperture 216. The inner aperture 244 is configured to receive a portion of the fastener assembly 82. Each inner finger 236 includes the inner aperture 244 positioned there though.

In the illustrated embodiment of the first hinge member 204, the components for a portion of the hinge assembly 200 are positioned on both ends of the first hinge member 204. This facilitates an articulating connection to a plurality of hinge members in series, with each articulating connection being defined by the hinge assembly 200. In other embodiments that incorporate only one hinge assembly 200, the components listed above associated with the first hinge member 204 are positioned on one end (or one portion) of the first hinge member 204 to provide a first portion of the hinge assembly 200.

A second portion of the hinge assembly 200 is provided on the second hinge member 208. It should be appreciated that the components listed above in association with the first hinge member 204 are similarly provided on the second hinge member 208.

Figure 6:
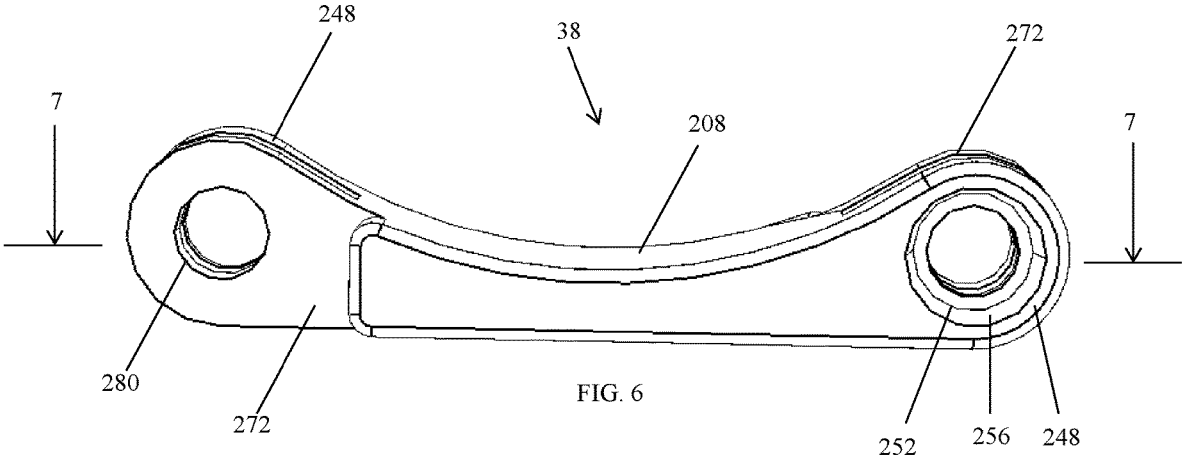
FIG. 6 is a side view of an embodiment of a second hinge member for use with the articulating head support of FIG. 1, illustrating components of the hinge assembly.
Figure 7:
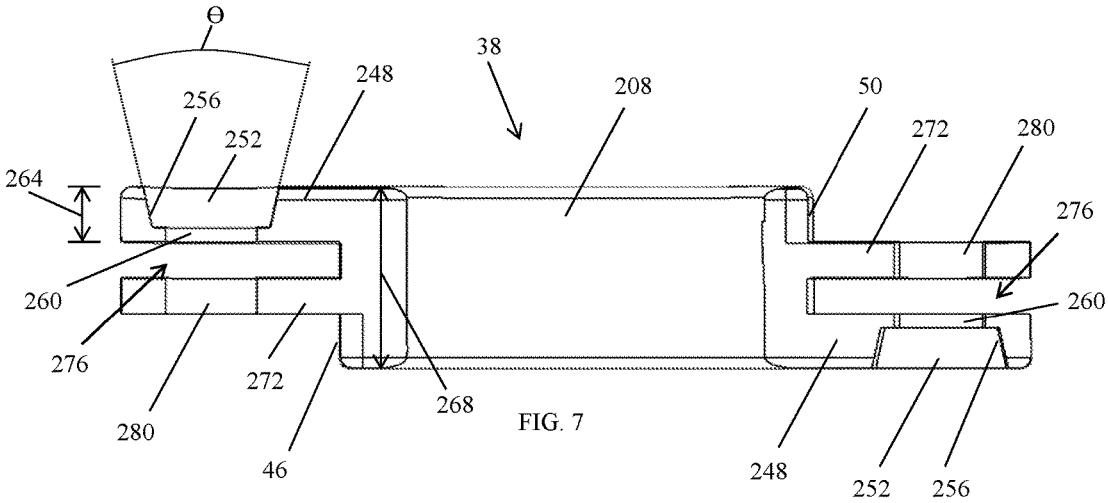
FIG. 7 is a cross-sectional view of the second hinge member of FIG. 6, take along line 7-7 of FIG. 6.

Referring to FIGS. 3 and 6-7, the second hinge member 208 includes a second outer finger 248. The second outer finger 248 is positioned on an end 46, 50 of the member 208. The second outer finger 248 defines an aperture 252 (or a second outer aperture 252 or a second aperture 252) that is configured to receive a portion of the fastener assembly 82. A circumference of the second aperture 252 includes a tapered surface 256 (or sloped surface 256). The tapered surface 256 defines a frustoconical cross-sectional shape. More specifically, and as shown in FIG. 7, with a cross-section of the second aperture 252 taken along a diameter, the opposing tapered surfaces 256 define an angle θ. The angle θ can be from approximately twenty degrees (20°) to approximately forty degrees (40°). The second aperture 252 includes an exit portion 260 that includes a diameter that is smaller than a diameter taken along the tapered surfaces 256. In other embodiments, the exit portion 260 can have a diameter that is equal to (or is no greater than, or is smaller than) the smallest diameter (or shortest diameter) taken across opposing tapered surfaces 256. While the tapered surface 256 of the second aperture 252 defines a frustoconical cross-sectional shape, in other embodiments the second aperture 252 can define a geometric, eccentric, or other shape having the tapered surface 256 around the circumference.

With continued reference to FIG. 7, the second outer finger 248 includes a width 264 (or thickness 264) that is less than a width 268 (or thickness 268) of the corresponding end 46, 50 of the second hinge member 208. The second hinge member 208 can also include at least one inner finger 272 that is positioned on the end 46, 50 of the member 208. In the illustrated embodiment, the second hinge member 208 includes a single inner finger 272. However, in other embodiments, the second hinge member 208 can include a plurality of inner fingers 272, or the second hinge member 208 does not include any inner fingers 272 (i.e., includes only an outer finger 248). Each inner finger 272 is spaced apart (or is offset) from the next consecutive finger. As shown in FIGS. 3 and 7, the inner finger 272 is spaced from the second outer finger 248 by a space 276. The inner finger 272 defines an aperture 280 (or inner aperture 280). The inner aperture 280 has a diameter that is approximately equal to the exit portion 260 of the first aperture 252. Stated another way, the diameter of the inner aperture 280 can have a diameter that is equal to (or is no greater than, or is smaller than) the smallest diameter (or shortest diameter) taken across opposing tapered surfaces 256 of the second aperture 252. The inner aperture 280 is configured to receive a portion of the fastener assembly 82. Each inner finger 272 includes the inner aperture 280 positioned there though.

In the illustrated embodiment of the second hinge member 208, the components for a portion of the hinge assembly 200 are positioned on both ends of the second hinge member 208. This facilitates an articulating connection to a plurality of hinge members in series, with each articulating connection being defined by the hinge assembly 200. In other embodiments that incorporate only one hinge assembly 200, the components listed above associated with the second hinge member 208 are positioned on one end (or one portion) of the second hinge member 208 to provide a second portion of the hinge assembly 200.

To form the hinge assembly 200, the outer fingers 212, 248 of the first hinge member 204 and the second hinge member 208 are aligned such that the outer apertures 216, 252 are aligned. In addition, in embodiments including at least one inner finger 236, 272, the fingers 212, 236, 248, 272 are interlayed (or intermeshed). More specifically, the inner fingers 236, 272 are received (or positioned in) the associated space 276, 240 of the other hinge member 208, 204. As such, the inner apertures 244, 280 align with the outer apertures 216, 252 to define a passage configured to receive the fastener assembly 82. It should be appreciated that the hinge members 204, 208 have the same number of fingers 212, 236, 248, 272 on each member 204, 208. Stated another way, the hinge assembly 200 includes an even total number of fingers (e.g., 2, 4, 6, 8, etc.). It should be appreciated that for ease of description, the fingers 212, 236, 248, 272 are collectively also referred to as fingers 54, while the spaces 240, 276 are collectively also referred to as space 58, while the apertures 216, 244, 280, 252 are collectively also referred to as apertures 62.

With reference to FIG. 3, the fastener assembly 82 includes a fastener 284, a first hub 288 (or a female portion 288), and a second hub 292 (or a male portion 292). The fastener 284 includes a threaded portion 296 and a head portion 300. The head portion 300 can be configured to receive a tool (not shown), such as an Allen wrench, a Phillips screwdriver, etc. In other embodiments, the head portion 300 can be substituted with a lever 300A to facilitate a "tool-less" adjustment of the fastener 284. The fastener 284 can be a screw, or other suitable threaded member to facilitate selective engagement with the hubs 288, 292. The fastener 284 may be received by a washer 304 (or a lock washer 304) before engagement with the hubs 288, 292. The washer 304 can provide assistance with unintentional loosening of the fastener 284.

Figure 8:
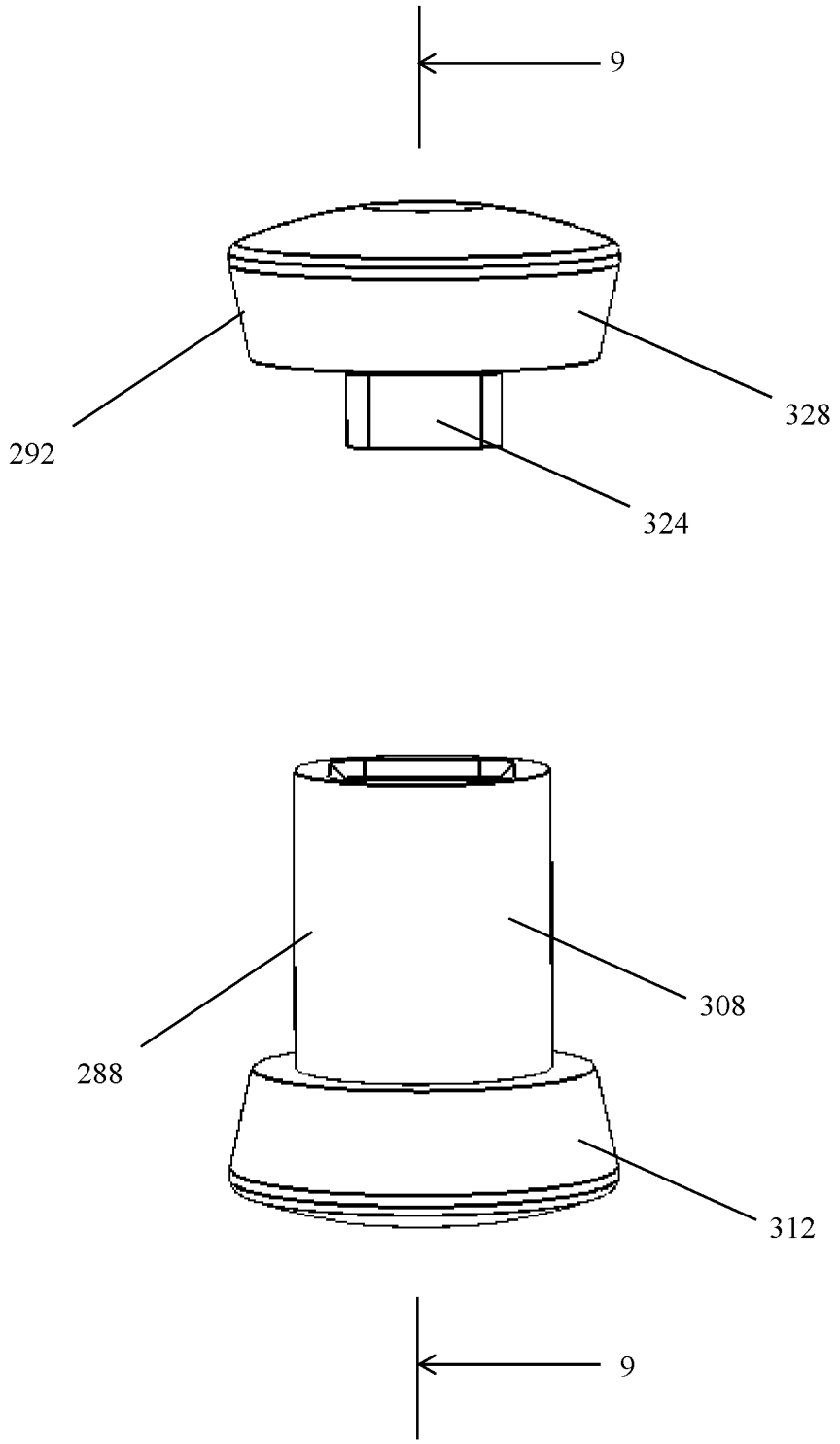
FIG. 8 is an exploded view of a portion of the fastener assembly for use with the hinge assembly.
Figure 9:
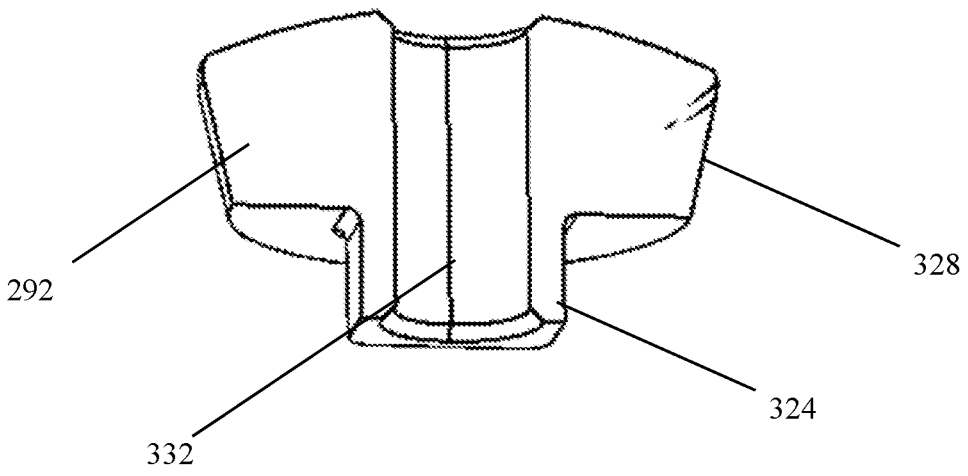
FIG. 9 is a cross-sectional view of the portion of the fastener assembly of FIG. 8, taken along line 9-9 of FIG. 8.
Figure 9:
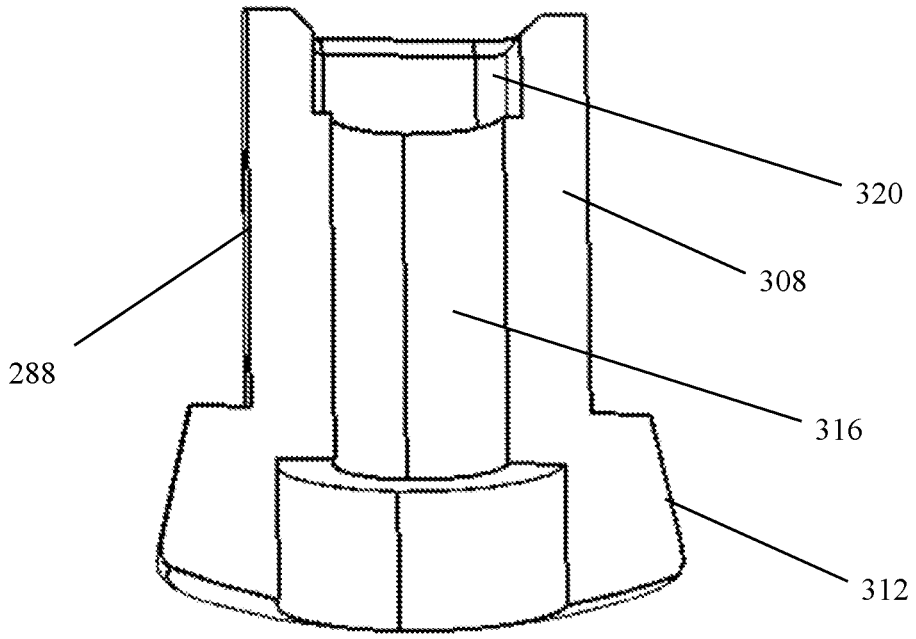
Figure 10:
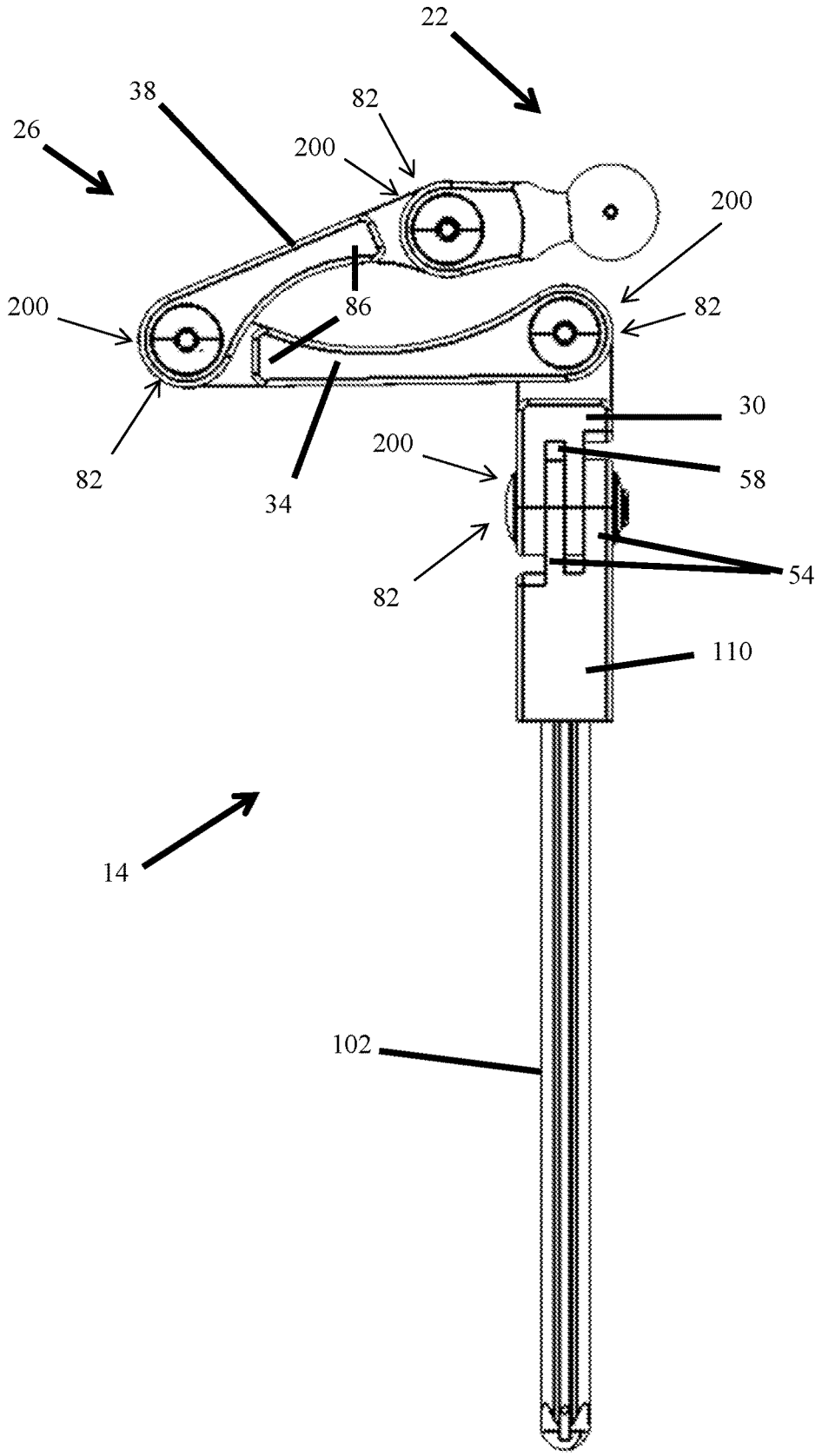
FIG. 10 is a first side view of the articulating head support of FIG. 1.

With reference now to FIGS. 8-9, the first hub 288 includes a shaft portion 308 and a tapered portion 312. The tapered portion 312 extends circumferentially around the first hub 288 and has a complimentary taper to the first aperture 216. More specifically, the tapered portion 312 is complimentary to the tapered surface 220 of the first aperture 216 (shown in FIG. 5). Stated another way, the tapered portion 312 of the first hub 288, when taken along a cross-section along a diameter, defines the angle θ, with the angle θ being from approximately twenty degrees (20°) to approximately forty degrees (40°). The shaft portion 308 has a diameter that is complimentary to the exit portion 224 (shown in FIG. 5). Further, the shaft portion 308 has a diameter that is complimentary to the inner apertures 244, 280. This allows the shaft portion 308 to be received by exit portion 224 and the inner apertures 244, 280 of each inner finger 236, 272. As shown in FIG. 9, the first hub 288 also defines a passage 316 (or channel 316) that extends though the first hub 288. The passage 316 is configured to receive the threaded portion 296 of the fastener 284. In the illustrated embodiment, the passage 316 does not include complimentary threads to engage the threaded portion 296. In other embodiments, the passage 316 can include threads configured to engage the threaded portion 296.

The first hub 288 also defines an opening 320 (or a recess 320) positioned along the passage 316 on an end opposite the tapered portion 312. The opening 320 is configured to receive a keyed projection 324 on the second hub 292. The projection 324 has a geometry that is complimentary to a geometry of the opening 320. This allows the opening 320 to receive the projection 324, coupling the hubs 288, 292 (or interlocking the hubs 288, 292), while also restricting rotation of the first hub 288 relative to the second hub 292 (or the second hub 292 relative to the first hub 288). In the illustrated embodiment, the projection 324 has a square shape, while the opening 320 has a complimentary square shape. In other embodiments, the projection 324 and the opening 320 can include any suitable complimentary, mating shape to facilitate engagement of the hubs 288, 292 and to restrict rotation of the hubs 288, 292 relative to each other. For example, the projection 324 and the opening 320 can include any suitable complimentary geometric shape (e.g., triangular, rectangular, pentagon, etc.), eccentric shape, non-circular shape, or a random shape.

As shown in FIGS. 8-9, the second hub 292 also includes a tapered portion 328. The tapered portion 328 extends circumferentially around the first hub 288 and has a complimentary taper to the second aperture 252. More specifically, the tapered portion 328 is complimentary to the tapered surface 256 of the second aperture 252 (shown in FIG. 7). Stated another way, the tapered portion 328 of the second hub 292, when taken along a cross-section along a diameter, defines the angle θ, with the angle θ being from approximately twenty degrees (20°) to approximately forty degrees (40°). As shown in FIG. 9, the second hub 292 also defines a passage 332 (or a channel 332) that extends though the second hub 292. The passage 332 is configured to receive the threaded portion 296 of the fastener 284. The passage 332 includes complimentary threads to engage the threaded portion 296 of the fastener 284.

In operation, the hinge assembly 200 is formed by aligning the outer fingers 212, 248 of the first hinge member 204 and the second hinge member 208 such that the corresponding outer apertures 216, 252 are aligned. In embodiments having at least one inner finger 236, 272 on the members 204, 208, the fingers 212, 236, 248, 272 are interlayed (or intermeshed or interposed). More specifically, each inner finger 236 of the first hinge member 204 is received by (or positioned in) an associated space 276 of the second hinge member 208. Similarly, each inner finger 272 of the second hinge member 208 is received by (or positioned in) an associated space 240 of the first hinge member 204. The inner apertures 244, 280 accordingly align with the outer apertures 216, 252 to define a passage. The fastener assembly 82 is then positioned in the passage. More specifically, the first hub 288 is received by (or positioned in) the first outer aperture 216 of the first hinge member 204. The tapered portion 312 of the first hub 288 engages the complimentary tapered surface 220 of the first outer aperture 216. The shaft portion 308 is received by the exit portion 224, and is also received by any inner apertures 244, 280 of the inner fingers 236, 272. The second hub 292 is received by (or positioned in) the second outer aperture 252 of the second hinge member 208. The tapered portion 328 of the second hub 292 engages the complimentary tapered surface 256 of the second outer aperture 252. The projection 324 of the second hub 292 extends through (or exits) the second outer aperture 252 through the exit portion 260. The projection 324 is then received by the corresponding opening 320 of the first hub 288, interlocking the hubs 288, 292 and restricting rotation of the first hub 288 relative to the second hub 292 (or the second hub 292 relative to the first hub 288). The fastener 284 is then placed into threaded engagement with the connected hubs 288, 292. More specifically, the fastener 284 is received by the first hub 288, with the threaded portion 296 being received by the passage 316 defined by the first hub 288. The threaded portion is then received by the passage 332 defined by the second hub 292. The passage 332 includes complimentary threads to engage the threaded portion 296. Thus rotation of the fastener 284 (e.g., by a tool, a lever 300A, etc.) compresses the first and second hubs 288, 292. Further, rotation of the fastener 284 compresses the outer fingers 212, 248 and the inner fingers 236, 272, together. More specifically, the outer fingers 212, 248 are drawn toward each other by the tapered portions 312, 328 of the hubs 288, 292. The compression of the first and second hubs 288, 292 minimize space between consecutive fingers 212, 272, 236, 248, while also engaging frictional forces between the consecutive fingers 212, 272, 236, 248. The compressive forces (or clamping forces) and frictional forces together assist to limit movement of the hinge members 204, 208 relative to each other.

With reference back to FIG. 3, the second and third articulating members 34, 38 include projections 86 that extend laterally outward from sides of the middle section 64. The projections 86 extend along portions of the articulating members 34, 38 that correspond to where an outer finger 54 is coupled to (or formed or integrally formed) with the ends 46, 50 of the members 34, 38. In the illustrated embodiment, the projections 86 extend from both sides of the middle section 64. In other embodiments, the projections 86 can extend from only one side of the middle section 64. The projections 86 are provided to increase the strength/rigidity of the associated member. In addition, the projections 86 limit the distance that the attached member can rotate. For example, as the second articulating member 34 rotates relative to the third articulating member 38, the second articulating member 34 will continue to rotate until the projection 86 on the second articulating member 34 comes into contact with a portion of the third articulating member 38 to restrict further movement about the second axis 70. Similarly, as the third articulating member 38 rotates relative to the second articulating member 34, the third articulating member 38 will continue to rotate until the projection 86 on the third articulating member 38 comes into contact with a portion of the second articulating member 34 to restrict further movement about the second axis 70. The projections 86 can also be positioned on the first articulating member 30 and/or the ball joint assembly 22.

As illustrated in FIGS. 1 and 2, a first end of the articulating portion 26 of the articulating arm 14 is connected to the height adjustment member 18 through the support stem 110. With specific reference to FIG. 2, an upper end 114 of the height adjustment member 18 extends through a recess (not shown) on the bottom of the support stem 110. A pin 118 couples the support stem 110 to the height adjustment member 18. The pin 118 extends through a first aperture 122*a* located on a first end 126 of the support stem 110 and a second aperture 122*b* on the upper end 114 of the height adjustment member 18. In response to the apertures 122*a, b* being positioned in alignment, the pin 118 is configured to be received by the apertures to couple the height adjustment member 18 to the support stem. The support stem 110 also includes fingers 54 that extend from a second end 130. The fingers 54 on the support stem 110 correspond to the fingers 54 on the first articulating member 30. In other words, the space 58 between the fingers 54 on the support stem 110 receives one of the fingers 54 of the first articulating member 30. Similarly, the space 58 between the fingers 54 on the first articulating member 30 receives one of the fingers 54 of the support stem 110. The interconnected fingers 54 align the apertures 62 on the fingers 54 to define a third axis 74 (shown in FIGS. 1 and 11), and a hinge assembly 200. The third axis 74 provides an axis of rotation that the first articulating member 30 can rotate with respect to the support stem 110. The fingers 54 on the first end 46 of the first member 30 and the fingers 54 on the second end 130 of the support stem 110 are connected with a fastener assembly 82. The third axis 74 is oriented perpendicular to the first and second axes 66, 70.

Figure 12:
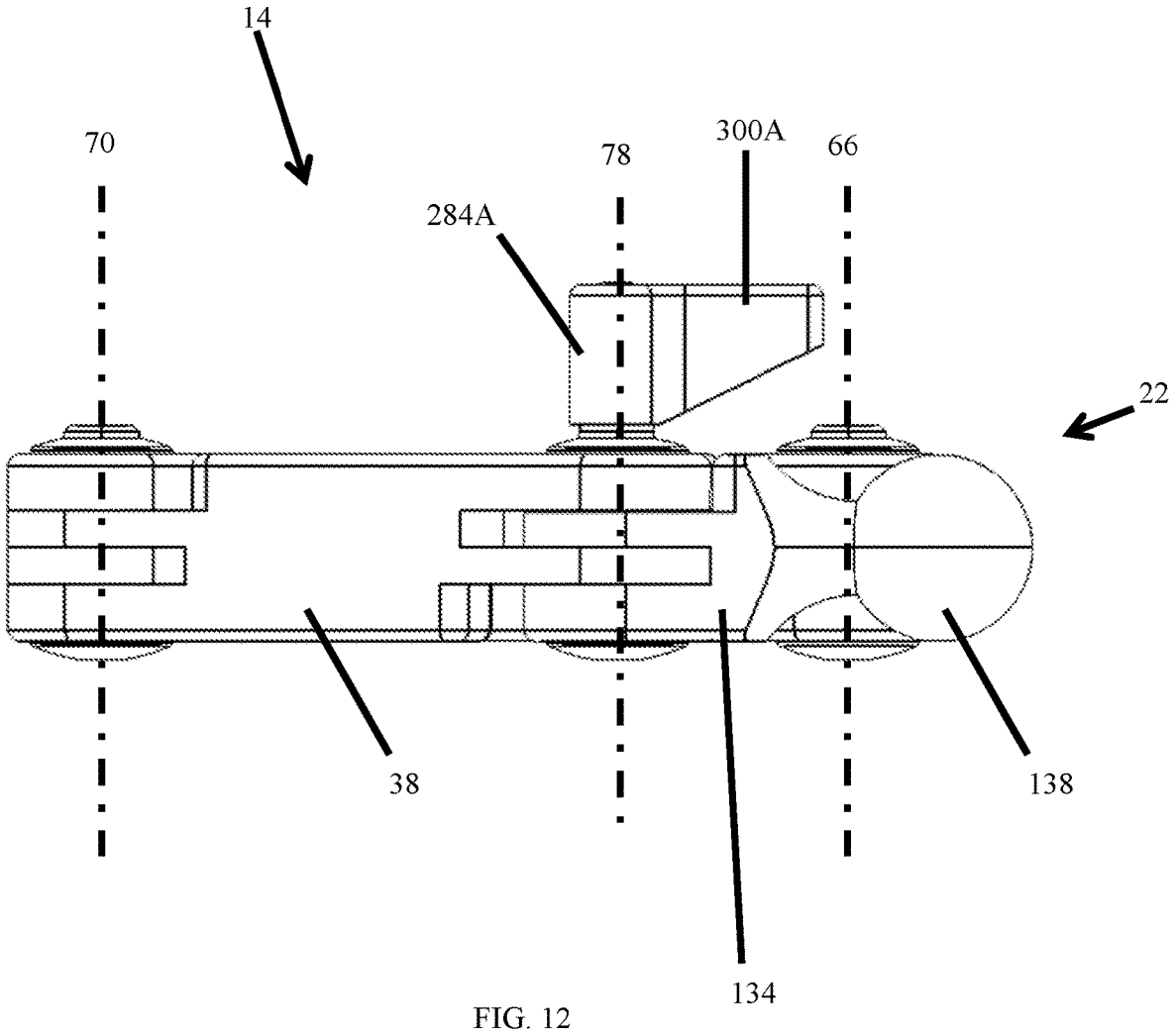
FIG. 12 is a top view of the adjustable head support of FIG. 1.

With reference to FIGS. 1 and 2, a second end of the articulating portion 26 of the articulating arm 14 is connected to the ball joint assembly 22. The ball joint assembly 22 includes the ball joint support 134 and a ball joint 138. With specific reference to FIG. 2, the ball joint 138 has a receptacle (not shown) configured to receive a shaft 142 that extends from a first end 146 of the ball joint support 134. A pin 118 is configured to be received by aligned apertures 122 in the ball joint 138 and the shaft 142 to secure the ball joint 138 to the ball joint support 134. The ball joint support 134 also includes fingers 54 that extend from a second end 150 of the ball joint support 134. In addition, a projection 154 extends laterally from a side of the ball joint support 134. In the illustrated embodiment, the fingers 54 on the second end 50 of the third articulating member 38 and the fingers 54 on the second end 150 of the ball joint support 134 are interlayed (or intermeshed) to align the respective apertures 62. The fingers 54 are then connected with the fastener assembly 82 (shown in FIGS. 1 and 12) to form the hinge assembly 200. The aligned apertures 62, and/or the fastener assembly 82, define a fourth axis 78 (shown in FIGS. 1 and 12). The third articulating member 38 and the ball joint support 134 are configured to rotate relative to each other about the fourth axis 78 (e.g., the third articulating member 38 can rotate relative to the ball joint support 134, and the ball joint support 134 can rotate relative to the third articulating member 38, etc.). The projection 154 on the ball joint support 134 can come into contact with the projection 86 (shown in FIG. 8) on the third articulating member 38 to limit the distance the ball joint assembly 22 can rotate about the fourth axis 78 (or the distance the third articulating member 38 can rotate about the fourth axis 78). As illustrated in FIGS. 1 and 12, the fourth axis 78 can be approximately parallel to the first and second axes 66, 70. As such the first, second, and fourth axes 66, 70, 78 allow for the second articulating member 34, the third articulating member 38, and the ball joint support 134 to respectively move (or articulate) along a first direction (or along the X-axis as shown in FIG. 1), and along a second direction (or along the Y-axis as shown in FIG. 1). As illustrated in FIGS. 1 and 9, the third axis 74 allows for the first member 30 to move relative to the height adjustment member 18 along a third direction (or along the Z-axis as shown in FIG. 1).

Figure 11:
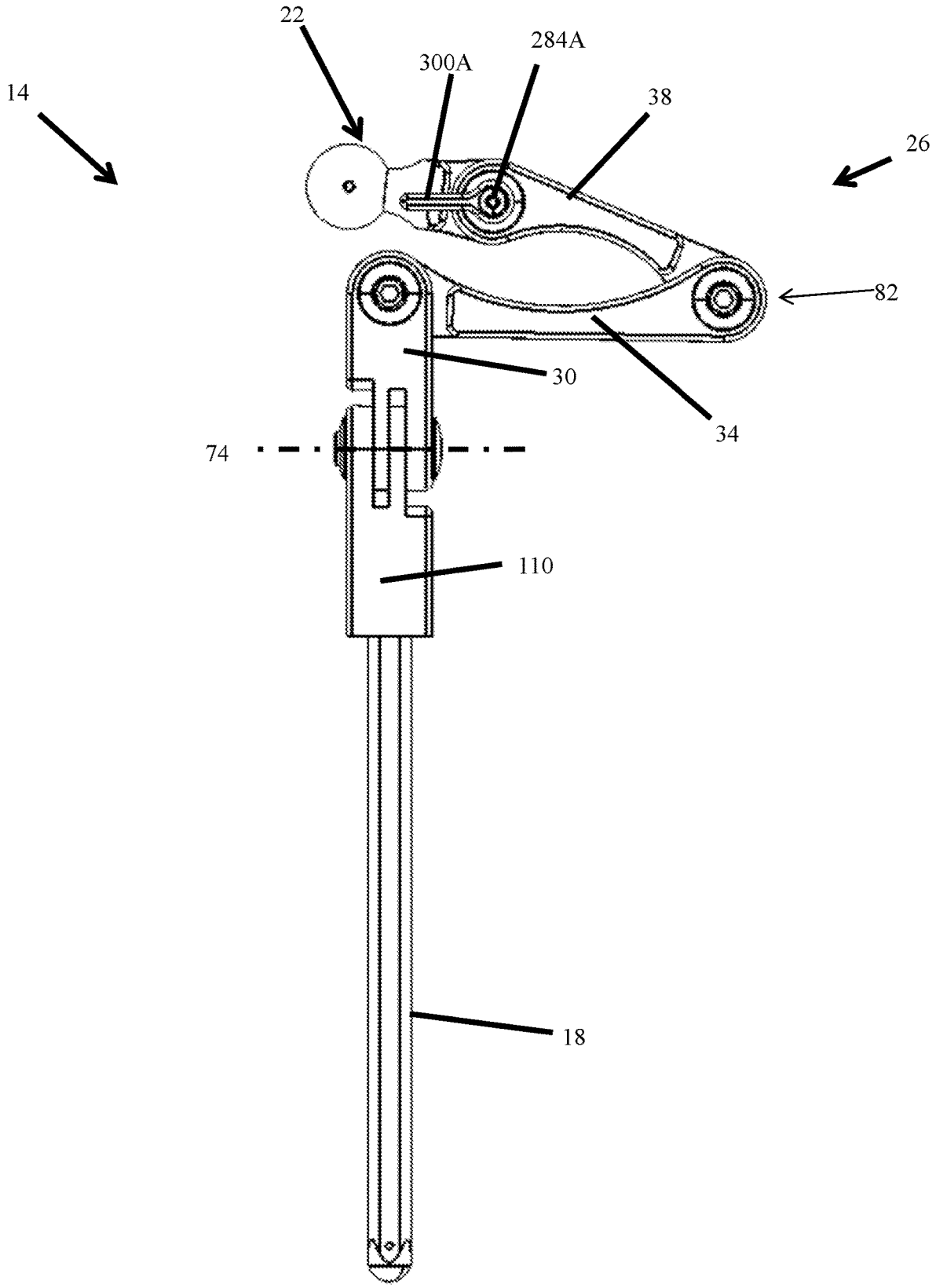
FIG. 11 is a second side view of the articulating arm of FIG. 1, the second side view being opposite the first side view of FIG. 10.

With reference to FIGS. 1, 11, and 12, the fastener 284A that couples the third member 38 to the ball joint assembly 22 includes the lever 300A (or a handle 300A) in place of the head portion 300. The lever 300A allows a user to selectively tighten or loosen the fastener 284*a* of the fastener assembly 82 associated with the hinge assembly 200 between the ball joint assembly 22 and the third articulating member 38. In this manner, the fastener 284A is a "tool-less" fastener, as it does not require a tool to selectively tighten or loosen the connection provided by the assembly, instead using the lever 162. When loosened, the user can adjust the position of the ball joint assembly 22 relative to the third articulating member 38. In other embodiments of the articulating arm 14, the ball joint assembly 22, the articulating members 30, 34, 38, and/or the height adjustment member 18 can be coupled by the fastener assembly 284A that includes the lever 162 to provide tool-less adjustment of the fastener assembly 82.

The ball joint assembly 22 is configured to connect to the head support pad (not shown). The ball joint 138 is received by a socket (not shown) in the head support pad (shown). The ball joint 138 is allowed to pivot within the socket to facilitate adjusting of the head support pad relative to the ball joint 138. The head support pad, socket, and ball joint 138 is substantially the same as the head support pad, socket, and ball joint disclosed in U.S. patent application Ser. No. 15/429,987, the contents of which is hereby incorporated by reference in its entirety. As such, the operation and associated movement of the head support pad relative to the ball joint assembly 22 and associated ball joint 138 is the same as disclosed therein.

In operation of the illustrated embodiment, the articulating head support 10 is attached to a chair (not shown). The articulating head support 10 is configured to be adjusted in three dimensions, relative to the X-axis, the Y-axis, and the Z-axis (shown in FIG. 1), to position the head support pad in any desired position or location in relation to the chair (or a user in the chair) in order to provide head support for the user.

To adjust the position of the articulating arm 14, the height adjusting member 18 can be repositioned relative to the chair (not shown) along the Y-axis to a desired height. For example, the height adjustment member 18 can slide relative to the mounting bracket (not shown) along the Y-axis. The first articulating member 30 can also be repositioned relative to the height adjustment member 18. For example, a user can loosen the fastener assembly 82 of the hinge assembly 200 and rotate the first articulating member 30 relative to the height adjustment member 18 about the third axis 74 to reposition the articulating portion 26 in the Y-Z plane. The second articulating member 34 can be repositioned relative to the first articulating member 30. For example, a user can loosen the fastener assembly 82 of the hinge assembly 200 and rotate the second articulating member 34 relative to the first articulating member 30 about the first axis 66, repositioning the articulating portion 26 in the X-Y plane. The third articulating member 38 can also be repositioned relative to the second articulating member 34. For example a user can loosen the fastener assembly 82 of the hinge assembly 200 and rotate the third articulating member 38 relative to the second articulating member 34 about the second axis 70, repositioning the articulating portion 26 in the X-Y plane. The ball assembly 22 can also be repositioned relative to the third articulating member 38. For example, a user can loosen the fastener assembly 82 of the hinge assembly 200 and rotate the ball assembly 22 relative to the third articulating member 38 about the fourth axis 78, repositioning the ball assembly 22 in the X-Y plane. The head support (not shown) can be adjusted about the X-axis, the Y-axis, and the Z-axis by rotation of the head support relative to the ball joint 138.

One or more aspects of the articulating head support 10 for a chair provides certain advantages. For example, the articulating head support provides for adjustment of the articulating arm 14 and the head support pad in three dimensions (along an X-axis, Y-axis, and/or Z-axis) to provide head support to different individuals using the chair, while taking into account factors that include different body types, impairments (e.g., paraplegia, quadriplegia, etc.) diseases and/or disorders.

Additionally, the hinge assembly 200 and associated fastener assembly 82 provides certain advantages. For example, the hinge assembly 200 and associated fastener assembly 82 provide counter directional resistance to rotation to maintain a tight connection. The first and second hubs 288, 292 interlock when engaged with the threaded member 284. The interlock restricts rotation of the second hub 292 during insertion of the threaded member 284 (i.e., the second hub 292 does not rotate as the threaded member 284 rotates). In addition, the associated tapered portions 312, 328 of each hub 288, 292 frictionally engage the associated tapered surface 220, 256 of the respective outer aperture 216, 252. Accordingly, this frictional engagement, in combination with the interlocked hubs 288, 292, provides the counter directional resistance to rotation to maintain the connection. Stated another way, when applying a rotational force on one of the hinge members 204, 208 the hub member 292, 288 on the opposite hinge member 208, 204 will counter the rotation by the frictional engagement between the tapered surfaces of the hub member 292, 288 on the opposite hinge member 208, 204. Thus, the hub member 292, 288 on the opposite hinge member 208, 204 applies a counter directional force to resist rotation of the hub member 288, 292 being rotated by the rotational force on the hinge member 204, 208. In addition, the hinge assembly 200 and associated fastener assembly 82 provide improved strength and clamping force to maintain the selected position of the hinge assembly 200. The clamping force applied by the first and second hubs 288, 292 on the outer fingers 212, 248 by the tapered portions 312, 328 of the hubs 288, 292 engaging the respective tapered surfaces 220, 256, and the subsequent clamping force applied to the consecutive fingers 212, 272, 236, 248 assists with maintaining the selected position of the hinge assembly 200. In addition, the taper angle of the tapered surfaces 220, 256 advantageously provides a balance of frictional force between the hubs 288, 292 and the respective outer fingers 212, 248, while also providing for easy removal of the hubs 288, 292 from the respective outer apertures 216, 252. Further, the hinge assembly 200 and associated fastener assembly 82 can be quickly and easily positioned and/or repositioned while providing improved strength characteristics. Disengaging the fastener 284 from the fastener assembly 82 (e.g., hubs 288, 292, etc.) allows rotation of one hinge member 204, 208 relative to the other hinge member 208, 204. Once a targeted or desired position (or orientation) of the hinge members 204, 208 is achieved, the fastener 284 is reengaged with the fastener assembly 82 (e.g., hubs 288, 292, etc.) to maintain the targeted or desired position of the hinge members 204, 208.

Additional features and advantages of the invention are set forth in the disclosure and the following claims.

What is claimed is:

1. A hinge assembly comprising:

a first hinge member including a first outer finger defining a first aperture, the first aperture including a first circumferential tapered surface;

a second hinge member including a second outer finger defining a second aperture, the second aperture including a second circumferential tapered surface; and a fastener assembly including a first hub, a second hub, and a fastener, the first hub including a circumferential tapered surface that is complimentary to the first circumferential tapered surface, and the second hub including a circumferential tapered surface that is complimentary to the second circumferential tapered surface, wherein the first hub defines an opening and the second hub includes a projection that is received by the opening to interlock the first and second hubs, and wherein the fastener assembly is configured to connect the first hinge member to the second hinge member by the first hub being received by the first aperture such that the circumferential tapered surface of the first hub engages the first circumferential tapered surface of the first aperture, the second hub being received by the second aperture such that the circumferential tapered surface of the second hub engages the second circumferential tapered surface of the second aperture, and the fastener coupling the first hub to the second hub.

2. The hinge assembly of claim 1, wherein the first and second apertures align to receive the fastener assembly.

3. The hinge assembly of claim 1, wherein the first hub defines a first passage there through, the second hub defines a second passage there through, and the fastener is received by the first and second passages.

4. The hinge assembly of claim 3, wherein the fastener includes a threaded portion, the threaded portion is received by the first passage and engages a complimentary threaded portion in the second passage.

5. The hinge assembly of claim 1, wherein the opening has a shape that is complimentary to a shape of the projection such that in response to being interlocked, the first hub is restricted from rotating relative to the second hub.

6. The hinge assembly of claim 5, wherein in response to being interlocked, the second hub is restricted from rotating relative to the first hub.

7. The hinge assembly of claim 1, wherein the first hub defines a first passage extending through the first hub and connected to the opening, the second hub defines a second passage extending through the projection and the second hub, and the fastener is received by the first and second passages.

8. The hinge assembly of claim 7, wherein the fastener includes a threaded portion, the threaded portion is received by the first passage, extends through the opening, and engages a complimentary threaded portion in the second passage.

9. The hinge assembly of claim 1, further comprising:

a first inner finger included on the first hinge member, the first inner finger defining a third aperture, the first inner finger separated from the first outer finger by a first space; and a second inner finger included on the second hinge member, the second inner finger defining a fourth aperture, the second inner finger separated from the second outer finger by a second space, wherein the fastener assembly is received by the first aperture, the fourth aperture, the third aperture, and the second aperture to connect the first hinge member to the second hinge member.

10. The hinge assembly of claim 9, wherein in response to the first hinge member being connected to the second hinge member, the second inner finger is received in the first space and the first inner finger is received in the second space.

11. The hinge assembly of claim 9, wherein a diameter of the third aperture does not exceed a diameter of the first aperture.

12. The hinge assembly of claim 11, wherein a diameter of the fourth aperture does not exceed a diameter of the second aperture.

13. The hinge assembly of claim 1, wherein the first hinge member is a first articulating member of a head support, and the second hinge member is a second articulating member of the head support.

14. A hinge assembly comprising:

a first hinge member including a first outer finger defining a first aperture;

a second hinge member including a second outer finger defining a second aperture; and a fastener assembly including a first hub, a second hub, and a fastener, the first hub defines an opening and the second hub includes a projection, wherein the fastener assembly is configured to be received by the first and second apertures, and the opening defined by the first hub is configured to receive the projection of the second hub to selectively connect the first hinge member to the second hinge member, and wherein the first hub defines a first passage extending through the first hub and connected to the opening, the second hub defines a second passage extending through the projection and the second hub, and the fastener is received by the first and second passages.

15. The hinge assembly of claim 14, wherein fastener includes a threaded portion, the threaded portion is received by the first passage, extends through the opening, and engages a complimentary threaded portion in the second passage.

16. The hinge assembly of claim 14, wherein the opening defined by the first hub is configured to receive the projection of the second hub to interlock the first and second hubs, wherein in response to being interlocked, the first hub is restricted from rotating relative to the second hub.

17. The hinge assembly of claim 14, further comprising:

a first tapered surface extending circumferentially around the first aperture; and a second tapered surface extending circumferentially around the first hub, wherein in response to the first hub being received by the first aperture, the first tapered surface engages the second tapered surface.

18. The hinge assembly of claim 14, further comprising:

a first tapered surface extending circumferentially around the second aperture; and a second tapered surface extending circumferentially around the second hub, wherein in response to the second hub being received by the second aperture, the first tapered surface engages the second tapered surface.

19. A hinge assembly comprising:

a first hinge member including a first outer finger defining a first aperture, the first aperture including a first circumferential tapered surface;

a second hinge member including a second outer finger defining a second aperture, the second aperture including a second circumferential tapered surface; and a fastener assembly including a first hub, a second hub, and a fastener, the first hub including a circumferential tapered surface that is complimentary to the first circumferential tapered surface, and the second hub including a circumferential tapered surface that is complimentary to the second circumferential tapered surface, wherein the fastener assembly is configured to connect the first hinge member to the second hinge member by the first hub being received by the first aperture such that the circumferential tapered surface of the first hub engages the first circumferential tapered surface of the first aperture, the second hub being received by the second aperture such that the circumferential tapered surface of the second hub engages the second circumferential tapered surface of the second aperture, and the fastener coupling the first hub to the second hub, and wherein the first hinge member is a first articulating member of a head support, and the second hinge member is a second articulating member of the head support.

20. The hinge assembly of claim 19, wherein the first and second apertures align to receive the fastener assembly.

21. The hinge assembly of claim 19, wherein the first hub defines a first passage there through, the second hub defines a second passage there through, and the fastener is received by the first and second passages.

22. The hinge assembly of claim 21, wherein the fastener includes a threaded portion, the threaded portion is received by the first passage and engages a complimentary threaded portion in the second passage.

23. The hinge assembly of claim 19, wherein the first hub defines an opening and the second hub includes a projection that is received by the opening to interlock the first and second hubs.

24. The hinge assembly of claim 23, wherein the opening has a shape that is complimentary to a shape of the projection such that in response to being interlocked, the first hub is restricted from rotating relative to the second hub.

25. The hinge assembly of claim 24, wherein in response to being interlocked, the second hub is restricted from rotating relative to the first hub.

26. The hinge assembly of claim 23, wherein the first hub defines a first passage extending through the first hub and connected to the opening, the second hub defines a second passage extending through the projection and the second hub, and the fastener is received by the first and second passages.

27. The hinge assembly of claim 26, wherein the fastener includes a threaded portion, the threaded portion is received by the first passage, extends through the opening, and engages a complimentary threaded portion in the second passage.

28. The hinge assembly of claim 19, further comprising:

a first inner finger included on the first hinge member, the first inner finger defining a third aperture, the first inner finger separated from the first outer finger by a first space; and a second inner finger included on the second hinge member, the second inner finger defining a fourth aperture, the second inner finger separated from the second outer finger by a second space, wherein the fastener assembly is received by the first aperture, the fourth aperture, the third aperture, and the second aperture to connect the first hinge member to the second hinge member.

29. The hinge assembly of claim 28, wherein in response to the first hinge member being connected to the second hinge member, the second inner finger is received in the first space and the first inner finger is received in the second space.

30. The hinge assembly of claim 28, wherein a diameter of the third aperture does not exceed a diameter of the first aperture.

31. The hinge assembly of claim 30, wherein a diameter of the fourth aperture does not exceed a diameter of the second aperture.

* * * * *